US006663395B2

(12) United States Patent
Sobhani

(10) Patent No.: US 6,663,395 B2
(45) Date of Patent: Dec. 16, 2003

(54) ELECTRICAL JOINT EMPLOYING CONDUCTIVE SLURRY

(75) Inventor: Mohi Sobhani, Encino, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/090,599

(22) Filed: Feb. 28, 2002

(65) Prior Publication Data

US 2003/0162422 A1 Aug. 28, 2003

(51) Int. Cl.[7] ..... H01R 39/00
(52) U.S. Cl. ..... 439/21; 439/5; 439/13
(58) Field of Search ..... 439/5, 13, 20, 439/21

(56) References Cited

U.S. PATENT DOCUMENTS 3,972,577 A * 8/1976 Charles et al. ..... 439/5
5,498,164 A * 3/1996 Ward et al. ..... 439/15

* cited by examiner

*Primary Examiner*—Renee Luebke
*Assistant Examiner*—Ann McCamey
(74) *Attorney, Agent, or Firm*—Colin M. Raufer; Leonard A. Alkov; Glenn H. Lenzen, Jr.

(57) ABSTRACT

An electrical joint that couples electric signals and current between objects that move relative to one another. A conductive slurry is disposed upon a first object and a conductor extends from a second object to engage the conductive slurry. The slurry comprises conductive particle suspended in a fluid carrying agent, such as oil. A non-conductive gel may be disposed upon the exposed surface of the conductive slurry to retain and protect it. The conductive slurry and non-conductive gel may be disposed within a channel on the object's surface so as to define their position and retain them in the desired area. The position of the conductive slurry is oriented and aligned to maintain continuous contact with the conductor as movement occurs. Linear, planar, circular and other movements are contemplated. The electrical joint can be readily adapted to printed circuit and printed wire technology.

37 Claims, 5 Drawing Sheets

ELECTRICAL JOINT EMPLOYING CONDUCTIVE SLURRY

BACKGROUND OF THE INVENTION

1. Field of the Invention

The present invention relates to electrical circuits. More specifically, the present invention relates systems and methods for coupling electrical signals and current between objects that move relative to one other.

2. Description of the Related Art

In many devices, electrical signals are coupled between rotating objects, or between objects that move relative to one another. A classic example is the commutator and brush arrangement used in electric motors and generators. Typically, the commutator is formed as plural conductive cylindrical rings insulatively supported about an armature shaft that rotates together with armature windings. The commutator rings are electrically coupled to the armature windings. The brushes are held in a fixed position relative to the motor frame, or stator windings, and are typically urged toward the commutator rings by spring force. The brushes rotatably engage the commutator rings so as to enable the flow of electric current between the fixed position brushes and the rotating commutator rings, which couple the current to the armature windings. Depending on the type of motor or generator involved, the brushes may be electrically coupled to the stator or field windings or the brushes may be coupled to an external circuit, such as a power supply.

Of course, those skilled in the art will appreciate that there are a great variety of systems and circuits that require the coupling of electric current, or electrical signals, between movably related objects. The relative movement between objects is frequently rotational, however, linear and other non-linear relative movements are also encountered from time to time. Consider the amusement park bumper car. The floor area is at a first electrical potential and the ceiling area is at another potential. A first "brush" engages the floor surface and second "brush" is coupled to a pole and extends upwardly to engage the ceiling surface. Since the floor and ceiling are at different electrical potentials, the bumper car is enabled to draw electric current to operate its lights and motor. The motion of the bumper car is constrained within a plane parallel to the floor, but is otherwise random in nature. Of course, there are numerous other examples of considerably more sophisticated systems that require the moveable coupling of electric current and signals between objects.

An example of a sophisticated system that utilizes the moveable coupling of is electric signals is the airborne radar system deployed in various aircraft. For example, an F-15 fighter aircraft employs a tactical radar system deployed within its nose cone. The radar comprises a phased array antenna that forms a narrow radio beam in both of the transmit and receive modes of operation. In order to enable wide-angle radar coverage, the radar antenna is mounted on gimbals that enable the antenna, and therefore the radar beam, to be mechanically steered by servo-actuators. To enable the coupling of electric signals and power between the moveable antenna and other circuits fixed relative to the F-15 airframe, an electromechanical contact arrangement is employed. In many ways, this contact arrangement is not unlike the classic commutator and brush arrangements discussed above. Basically, two solid conductors are held in physical contact as they move relative to one another so as to maintain electrical continuity therebetween.

There are a number of problems associated with the conventional electromechanical coupling of signals through a commutator and brush arrangement. The effect of the brush dragging on the commutator causes friction. The friction produces heat and causes wear of the brush and commutator surfaces. The heat changes the electrical characteristic of the coupling, in particular altering the resistivity of the coupling. The wear implies that maintenance will ultimately be required. The electromechanical coupling is not perfect and thus is a source of electrical noise during operation. The noise results from variations in the quality of the signaling coupling. In extreme cases, arcing and loss of signal coupling can occur. Noise problems tend to increase as the mechanical components wear. This noise degrades the signal to noise ratio of the coupled signal, and can interfere with reliable operation. The noise created by electromechanical couplings can also radiate to interfere with other devices. In some circumstances, the noise power bandwidth may interfere with radio frequency devices causing other system's reliability of be reduced.

Thus there is a need in the art for an apparatus for transferring electrical signals and electrical power between objects moveably related to one another, which improves reliability, reduces noise, minimizes coupling resistance, and allows flexible application in a variety of technologies.

SUMMARY OF THE INVENTION

The need in the art is addressed by the electrical joint of the present invention. The inventive electrical joint includes a first object that is moveably aligned with a second object. A conductive slurry is deposited upon a first surface of the first object, and a conductor is coupled to the second object and is aligned to maintain conductive coupling with the conductive slurry while the first object and the second object move relative to one other.

In a specific embodiment, the conductive slurry may comprise metallic particles suspended in a fluid. The metallic particles may be silver or copper. The first object may be formed from an insulator, such as polymide.

In a specific implementation of the foregoing invention, a non-conductive is disposed upon the exposed surface of the conductive slurry, and the conductor extends through the non-conductive gel to maintain the conductive coupling. The non-conductive gel may be hydraulic vacuum oil. In a further refinement, the conductive slurry is disposed within a channel of the first surface, and, the channel is positioned to maintain alignment with the conductor as the objects move relative to one another. The channel may be defined by a groove formed in the first surface or by built-up material extending from the first surface. The coupling of electrical signals is accomplished with a conductive coating disposed upon the first surface at a position to electrically couple the conductive slurry to the conductive coating. The conductive coating may be electroplated to the first surface.

In one embodiment, the first surface is substantially planar and the objects are constrained to move parallel to the first surface. In a second embodiment, the first object and the second object are moveably aligned about an axis or rotation, and, the first surface is cylindrical, having a centerline aligned with the axis of rotation. The conductor is a conductive blade that extends radially from the second object to maintain conductive coupling with the conductive slurry as the first object and the second object rotate with respect to one another. The blade may be a conductive disk. In a third embodiment, the first surface is planar and the second object is moveably aligned to rotate about an centerline extending perpendicular from the first surface, and the conductive slurry is disposed along a circular path defined by the movement of the conductor as the first object and the second object rotate with respect to one another. The conductor may be a conductive dowel extending from the second object to engage the circular path of conductive slurry. To improve reliability, the conductor may include a plurality of dowels extending from the second object and located at positions about a circle such that all of the dowels engage the circular path of conductive slurry.

DESCRIPTION OF THE INVENTION

Figure 1:
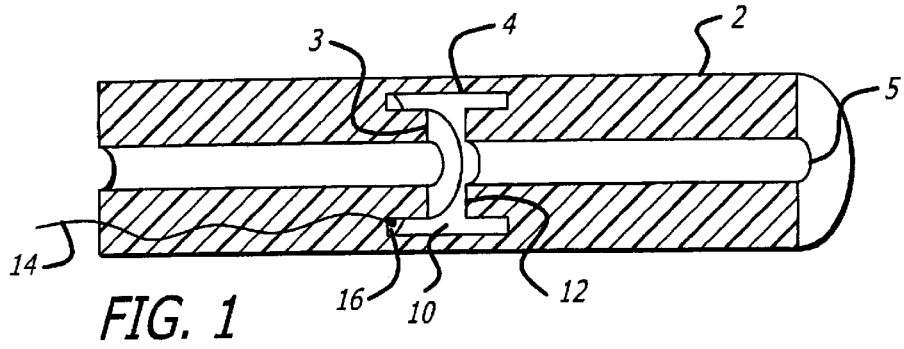
FIG. 1 is a section view of the outer portion of an axially rotating electrical joint in an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

The present invention teaches a novel apparatus for coupling electrical signals and current between moveably aligned objects. As noted herein before, the relative movement between two conductive circuits is at the center of the problem known in the prior art. The present invention overcomes the problem in the prior art by employing a conductive slurry, a fluid (or semi-fluid), at the point of relative movement between two objects.

According to the present invention, each object has a conductor or conductive material in contact with the conductive slurry. A circuit is formed from a conductor aligned with a first object, through the conductive slurry, and to a conductor aligned with the second object. As the objects move relative to one another, the conductive slurry accommodates the movement while continuously maintaining conductivity through the circuit. The conductive slurry employed in the illustrative embodiment is a mixture of solid metal particles in a fluid-carrying agent, which may be oil, for example. The oil is selected to meet operating requirements, which may include temperature swings from minus forty degrees Celsius to plus eighty degrees Celsius. The fluid-carrying agent may have conductive properties in and of itself. The slurry, being a fluid, creates less friction between the two objects moving relative to one another than would two solid objects physically engaging one another. Lessening friction reduces heat generated in the electrical joint, and greatly reduces mechanical wear of the conductive components. In the prior art, when two solid objects where slideably engaged to conduct current across a moveable joint, the objects rubbed together generating heat and causing the materials to deteriorate. By application of the teachings of the present invention, there is a reduction in friction and a corresponding reduction in heat. Thus, the present invention overcomes the friction and heat build-up problems in the prior art and extends the life of the electrical joint. The reduction in friction also results in a reduction in the amount of energy required to move the objects relative to one another and consequently makes the present invention electrical joint system more efficient.

The conductive slurry taught in the present invention is comprised of conductive particles suspended in a fluid-carrying agent. Many conductive particle materials can be employed, including metals such as gold, silver, copper, aluminum, iron, other metals, or alloys of such metals. Non-metals may also be employed, such as graphite or semi-conductive materials, for example. Those skilled in the art will appreciate the any particulate material that possesses conductive or semi-conductive properties could be employed in the present invention. The selection of a suitable particulate material is constrained by the circuit conductivity requirements, empirical performance tests, and cost. The ratio of particulate material to carrying agent (called a slurry ratio) is determined in part by the resistivity requirements and current carrying requirements of the circuit application. The slurry ratio may also be varied according to environmental factors, such as heat, humidity, vibration, etc. The carrying agent may be any of a variety of fluids or semi-fluids. In an illustrative embodiment, an oil with wide temperature specifications is employed.

It is beneficial to protect the exposed surface of the conductive slurry, as this will extend the useful life of the moveable coupling. Such protection prevents the movement and dissipation of the conductive slurry from its desired position. To achieve this improvement, the present invention teaches that mechanical structure and arrangements in the relative position of objects can be used to retain the conductive slurry. Also, a non-conductive gel is applied to cover and retain the conductive slurry.

Figure 2:
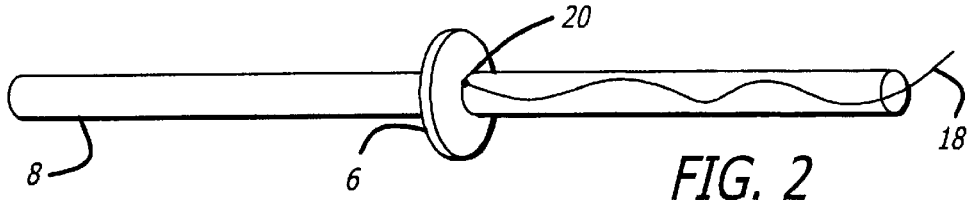
FIG. 2 is a perspective view of the inner portion of an axially rotating electrical joint in an illustrative embodiment of the present invention.

Reference is directed to FIG. 1 and FIG. 2, which depict first and second objects, respectively, that are combined to form a rotary electrical joint according to an illustrative embodiment of the present invention. FIG. 1 is a section view of the outer cylindrical portion 2 of the rotary electrical joint. The cylinder 2 is fabricated from a non-conductive material. The cylinder has a bore hole 5 aligned with and centered on the axis of the cylinder 2. The bore hole 5 provides clearance for a shaft, discussed below. An annular channel 3 is formed inside the cylinder 2 as an extension of the bore hole 5 opening. At the outer periphery of the annular channel 3 is an enlarged annular cavity 4. The aforementioned conductive slurry 10 is disposed within the annular cavity 4, and may extend somewhat into the annular channel 3. The conductive slurry 10 has an exposed surface in the area of the annular channel 3. The exposed surface of the conductive slurry 10 is covered with the aforementioned non-conductive gel 12, which serves to protect, retain, and isolate the conductive slurry 10. A portion of the annular cavity 4 surface is plated with a conductive material 16, which is conductively coupled to a conductor 14. Since the conductive slurry 10 contacts the plated surface 16, and the conductor 14 is coupled to plated surface 16, the conductive surface is effectively coupled to conductive slurry 10.

The second object of the conductive joint is depicted in FIG. 2. A shaft 8, which is preferably fabricated from a non-conductive material, has a conductive blade 6 affixed thereto. Alternatively, the shaft 8 can be fabricated from a conductive material, but with an insulative connection to the conductive blade 6. A conductor 18 passes through the shaft 8 and is electrically coupled to conductive blade 6. The shaft 8 and blade 6 assembly is placed into bore hole 5 of cylinder 2. The conductive blade is aligned with annular channel 3 and annular cavity 4. The conductive blade extends far enough along its radial dimension from shaft 8 so that the blade 6 passes through the non-conductive gel 12 to engage the conductive slurry 10 disposed within annual cavity 4. The assembly of these two objects provides for the conduction of electric current and signals through conductor 14, through the plated surface 16, through the conductive slurry 10, through the conductive blade 6, and through conductor 18. As the objects rotate with respect to one another, the continuous conduction of electric current and signals is maintained.

Figure 3:
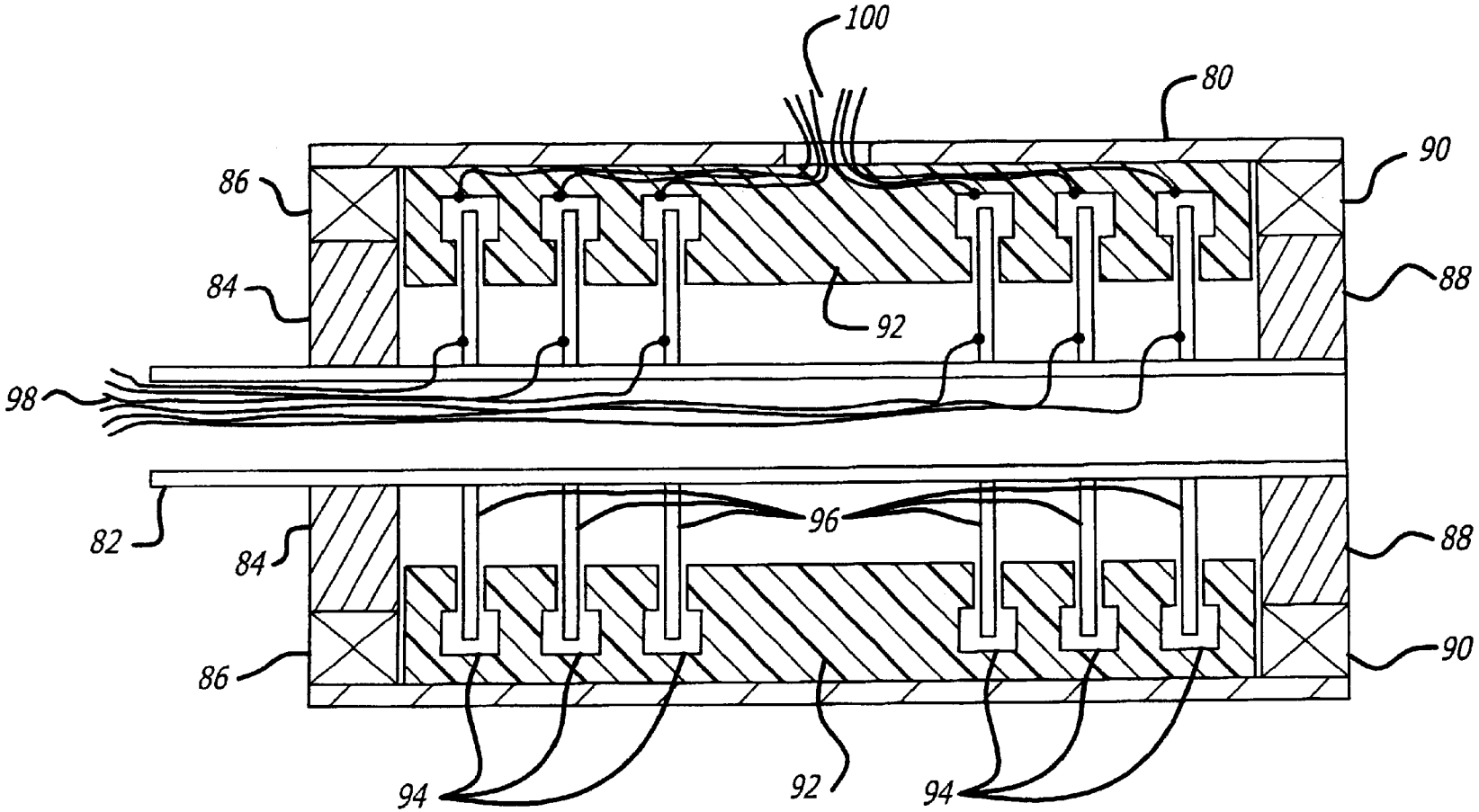
FIG. 3 is a section view of a multiple conductor rotary electrical joint according to an illustrative embodiment of the present invention.

Reference is directed to FIG. 3, which is a section view of a multiple conductor rotary electrical joint according in an illustrative embodiment of the present invention. Both objects, or halves of the joint, are depicted in the section view of FIG. 3. A shaft 82 is coupled to two bearing supports 84 and 88, which are rotatively coupled to tube 80 by ball bearings 86 and 90. Thus, the shaft 82 is free to rotate with respect to tube 80 by virtue of ball bearings 86 and 90. Disposed along the length of shaft 82 are six conductive blades 96. In the illustrative embodiment, the blades 96 are in the shape of disks. The blades 96 are rigidly and insulatively connected to shaft 82. Within tube 80 is an insulative cylinder 92, which is supported by tube 80. The inside cylindrical surface of insulative cylinder 92 has six annular channel recesses 94 formed therein. The annular channel recesses 94 are sized and positioned to encompass, but not to interfere with, the rotational movement of the conductive blades 96. Each annular recess has a plated portion (not shown) on its inside surface, each of which has a conductor 100 conductively coupled thereto. Each of the conductive blades 96 has a conductor 98 conductively coupled thereto. Conductors 98 are routed through the center of shaft 82. Each of the annular recesses 94 is filled with a conductive slurry (not shown), which is protected by a non-conductive gel (not shown). The physical arrangement of the slurry and gel, as well as specifics about the configuration of annular channel recesses 94, are more fully described with respect to FIG. 5 and FIG. 6 below. In FIG. 3, electric signals and current are rotatively coupled by conduction through conductors 98, through conductive blades 96, trough the conductive slurry (not shown), through the plated surface portion (not shown), and through conductors 100. In this fashion, multiple electrical signals can be rotatively coupled through a single axis or rotation by utilization of the teachings of the present invention.

Figure 4:
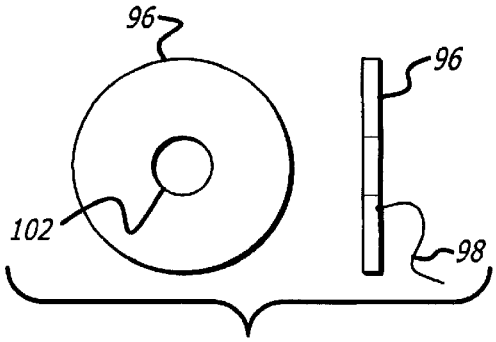
FIG. 4 is a detail view of a single conductive blade.

FIGS. 4A and 4B are detailed views of a conductive blade as employed in the illustrative embodiment in FIG. 3. FIG. 4A is a side view of the conductive blade 96, and FIG. 4B is an end view of conductive blade 96. The blade 96 is circular and fabricated from a conductive metal, such as copper for example. The blade 96 has a hole 102 formed at its center to allow passage through and coupling of the support shaft (Item 82 in FIG. 3). The conductor 98 is conductively coupled to blade 96. In the illustrative embodiment, the conductor 98 is an insulated copper wire that is soldered to conductive blade 102.

Figure 5:
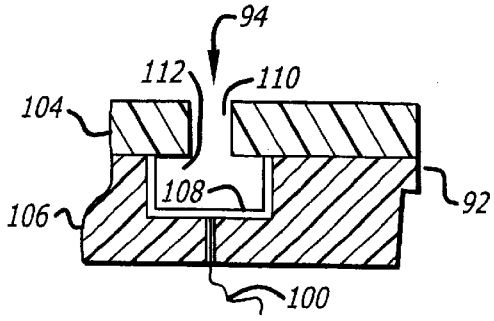
FIG. 5 is a section view of a single channel for receiving conductive slurry.

Reference is directed to FIG. 5, which is a section detail of a portion of insulative cylinder 92 at a single annular channel recess 94, as described with reference to FIG. 3, above. FIG. 5 also serves to illustrate a fabrication approach applicable in the illustrative embodiment for forming the annular channel recess 94. In particular, the insulative cylinder 92 is comprised of an inner insulative cylinder 104 and an outer insulative cylinder 106. The outer cylinder 106 has six annular channel recesses 112 formed on its inside surface. The inner cylinder 104 has six annular recesses 110 of material removed through its periphery. The width of annular recess 110 is smaller than the width of annular channel 112. When the two cylinders 106 and 104 are combined, an annular channel recess 94, as illustrated, is formed. The outer cylinder 106 has a conductive material 108 plated to the inside surface of annular channel recess 112. A conductor 100 passes through the outer wall of outer cylinder 106 to allow coupling of electric signals and current to the conductive plating material 108.

Figure 6:
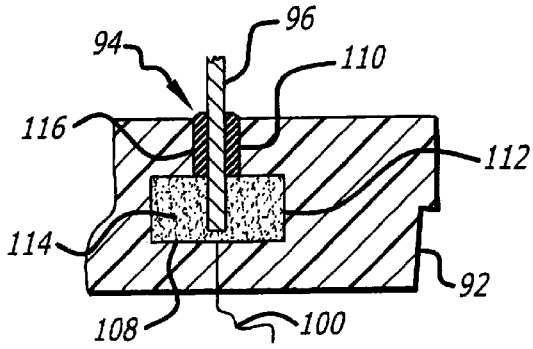
FIG. 6 is a section view of a single channel and it corresponding conductive blade with conductive slurry and non-conductive gel in place.

FIG. 6 is a section detail of a portion of insulative cylinder 92 at a single annular channel recess 94 with the conductive slurry 114, the non-conductive gel 116, and the conductive blade in place 96. The conductive slurry 114 is disposed within the wider portion 112 of annular channel recess 94. The conductive blade 96 extends into this area 112 as well. Electric current is coupled from the conductive blade 96, though the conductive slurry 114, to the plated surface 108. The plated surface 108 is conductively coupled to conductor 100, as was described above. A non-conductive gel 116 is disposed within the narrower portion 110 of annular channel recess 94. As was described herein before, the non-conductive gel 116 serves to protect, retain, and isolate the conductive slurry 114, while allowing the conductive blade 96 access to the conductive slurry 14 while the shaft 82 and cylinder 80 rotate with respect to one another.

Figure 7:
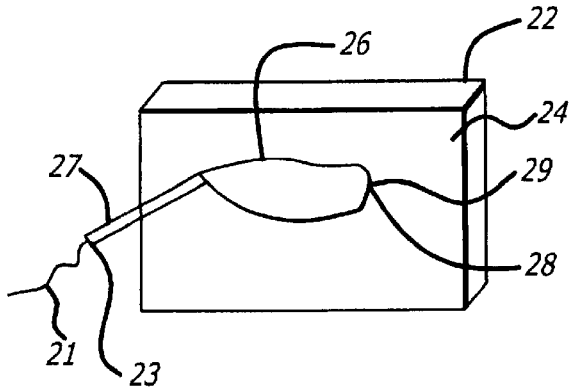
FIG. 7 is a perspective view of a planar electrical joint in an illustrative embodiment of the present invention.

Reference is directed to FIG. 7, which is a perspective view of an electric joint according to an illustrative embodiment of the present invention in which two objects move relative to one another, but are constraint to move within a two dimensional planar area. A first object 22, that is made of a non-conductive material, has a substantially planar surface 24. A conductive slurry 26 is disposed upon surface 24 along a path that is defined by the movement through which the planar motion of the joint will occur. For example, this may be the path defined by a cam-follower mechanism. A channel recess may also be formed into surface 24, and may include a layer of non-conductive gel, as is described with respect to the other embodiments herein. In FIG. 7, a conductive dowel 27 extends from a second object (not shown) and is aligned to make physical contact with the conductive slurry 26. A conductor 29 is moveably and electrically coupled with the conductive slurry 26 at connection point 28. A conductor 21 is electrically connected with the dowel 27 at connection point 23. The alignment is such that with relative movement, the dowel remains in physical contact with the conductive slurry 26, which in turn provides an electrical joint. Those skilled in the art will appreciate that multiple conductive paths, or circuits, can be laid out in parallel on surface 24, with corresponding multiple dowels, so that multiple conductor circuits can operate. In a further comprehension, those skilled in the art will appreciate that non-planar motion can also be accommodated through utilization of the teachings herein. In fact, any repetitive circuit of motion can be adapted to the teachings herein.

Figure 8:
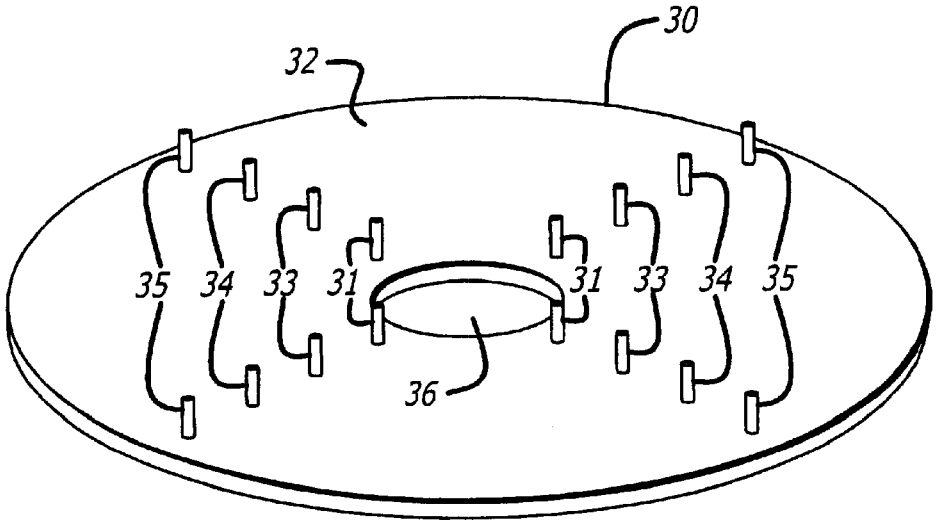
FIG. 8 is a perspective view of a first mating piece in a planar rotating electrical joint in an illustrative embodiment of the present invention.

Reference is directed to FIG. 8, FIG. 9, FIG. 10, and FIG. 11, which illustrate components and details of an illustrative embodiment of the present invention as applied to a rotary joint having an axis or rotation substantially perpendicular to two planar surfaces. FIG. 8 depicts, in perspective, a first object 30 that is fabricated from a non-conductive material. The material may be polymide or other suitable printed circuit or printed wire board material as are known to those skilled in the art, for example. Surface 32 is substantially planer and is formed as a circle. Object 30 has a circular opening 36 formed near the center of the surface 32. Conductive rods extend from surface 32 along several radii from the center of surface 32. The rods are affixed to the object 30 by soldering each to a plated-through hole (not visible). Plated-through holes are known to those skilled in the art. In particular, four conductive rods 31 are place at ninety-degree increments and at equal distance from the center of object 30, and the center defines the axis of rotation of the illustrative embodiment rotary joint. As such, each of the four rods 31 follow the same circumferential path as the object 30 rotates about it center. Similarly, each of the four rods 33 are placed at ninety degrees and at equal distance from the center. Each of the four rods 34 are placed at ninety degrees and at equal distance from the center. Each of the four rods 35 are placed at ninety degrees and at equal distance from the center. Thus, four circular paths are defined by the sixteen rods 31, 33, 34, and 35. In the illustrative embodiment, object 30 is fabricated from an insulator. It will be appreciated by those skilled in the art that an insulator is chosen for the purpose of electrically isolating each of the rods from one another. This is done so that they may be utilized as individual conductive elements is circuit. The object 30 could be fabricated from a conductive material, however, this would require that the conductive rods be supported using some other insulative technique.

Figure 9:
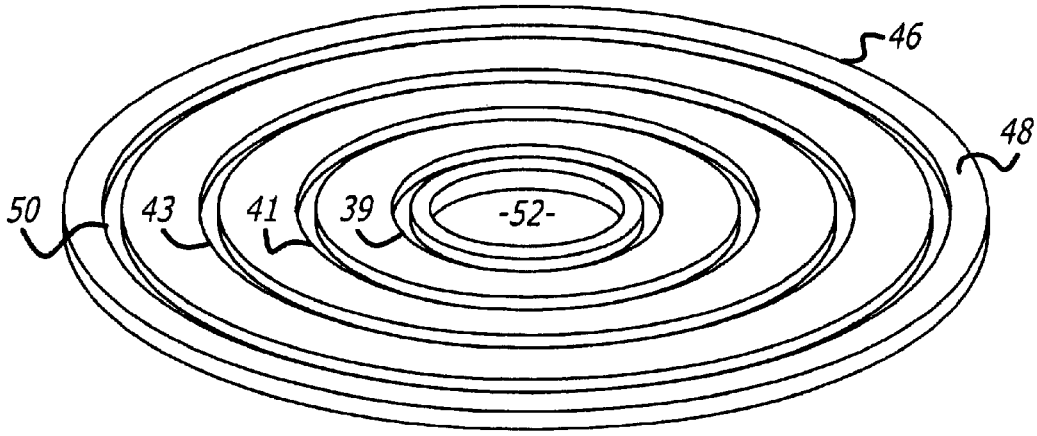
FIG. 9 is a perspective view of a second mating piece in a planar rotating electrical joint in an illustrative embodiment of the present invention.

FIG. 9 illustrates, in perspective, the second object 46 that is used in conjunction with the foregoing object 30 to embody a rotary electrical joint in an illustrative embodiment of the present invention. The second object 46 is fabricated from a non-conductive material, such as polymide or other suitable printed circuit or printed wire board material as are known to those skilled in the art, for example. The second object 46 has a surface 48 that is substantially planer. Four circular channels 39, 41, 43, and 50 are formed within surface 48. The center of the circular channels define the axis of rotation of the rotary electrical joint in the illustrative embodiment. A circular opening is formed at the center of the surface 48 through object 46. The radii of the four circular channels 39, 41, 43, and 50 correspond to the four radii defined by the placement of conductive rods 31, 33, 34, and 35 respectively.

It will be appreciated that four conductive dowels will engage each circular channel when the first object 30 and the second object 46 are aligned by the aforementioned axis of rotation with their respective planar surfaces 32 and 48 in close proximity. As will be discussed more fully below, each circular channel has conductive slurry disposed therein. This arrangement provides that four dowels are electrically coupled to each circular channel that is filled with conductive slurry. This provides multiple paths for the electrical signal or current coupled between the two objects. By using this technique, better performance of the rotary electrical joint is achieved both in terms of reliability and current carrying capability. Those skilled in the art will appreciate that any number of conductive dowels could be paralleled in this fashion to meet design objectives.

Figure 10:
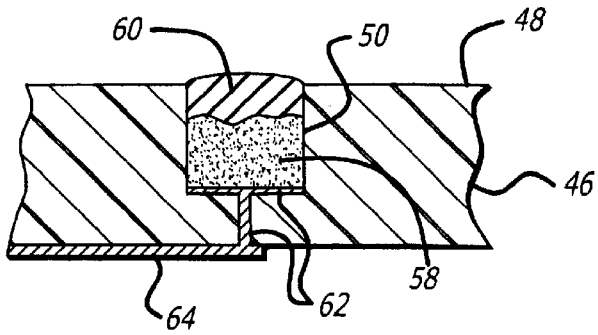
FIG. 10 is a section detail of a single groove in a planar rotating electrical joint in an illustrative embodiment of the present invention.

FIG. 10 is a section view of the second object 46 at circular channel 50 discussed respecting FIG. 9. In FIG. 10, the second object 46 has circular channel 50 formed therein. Within the circular channel 50 is disposed a conductive slurry 58 of the similar type descried herein before. A non-conductive gel 60 is disposed upon the exposed surface of the conductive slurry 58. The bottom of circular channel 50 is plated with a conductor 62 that passes through second object 46 and is electrically coupled to printed circuit conductor 64. Each of the other circular channels 39, 41, and 43 are structured in the same way.

Figure 11:
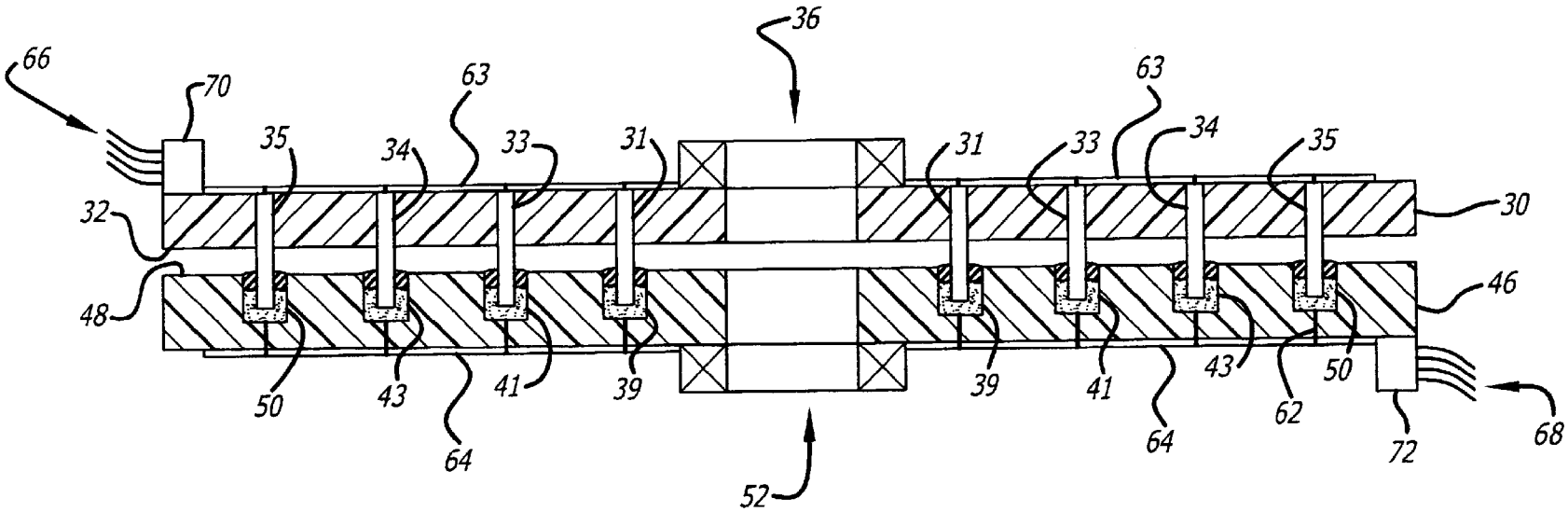
FIG. 11 is a section view of a planar rotating electrical joint in an illustrative embodiment of the present invention.

FIG. 11 illustrates a section view showing both the first object 30 and the second object 46 when they are aligned about their axis of rotation. The planar surfaces 32, 48 in such proximity that the conductive dowels 31, 33, 34, and 35 engage the conductive slurry disposed within the circular channels 39, 41, 43, and 50 respectively. Further details of the assembly and circuit coupling also appear in FIG. 11. The first object 30 has a support bearing 61 that allows the first object 30 to rotate about its axis. The plurality of conductive dowels 31, 33, 24, and 35 are supported by the first object 30 and extend from the first planar surface 32. The conductive dowels are electrically coupled to a plurality of printed circuit traces 63 that route electrical signals and current from the conductive dowels to a junction point 70. The junction point 70 serves to couple the printed circuit traces 63 to a plurality of conductive wires 66. Such junction points 70 are known to those skilled in the art. The second object 46 comprises the aforementioned circular channels 39, 41, 43, and 50 disposed upon the second planar surface 48. The second object 46 has a support bearing 65 that allows the second object 46 to rotate about its axis. Each of the circular channels are filled with conduct slurry, covered by non-conductive gel, as was described in reference to FIG. 10. In FIG. 11, a plurality of printed circuit traces 64 coupled the plated bottom of each circular channel to a junction point 72. The junction point 72 serves to couple the printed circuit traces 64 to a plurality of conductive wires 68. Such junction points 72 are known to those skilled in the art.

When first object 30 and second object 46 oriented in the position illustrated in FIG. 11, and installed on a common shaft (not shown) inserted through opening 36 and opening 52, the two objects are free to rotate with respect to one another. Surface 48 and surface 32 are positioned together to allow the plurality of conductive dowels to engage the conductive slurry as the two object rotate. The plurality of dowels pass through the non-conductive gel 60 into the conductive slurry 58. As the objects rotate relative to one another the plurality of dowels remain in contact with the slurry, thereby enabling the conduction of electric signals and current as the object rotate.

Thus, the present invention has been described herein with reference to a particular embodiment for a particular application. Those having ordinary skill in the art and access to the present teachings recognizes additional modifications applications and embodiments within the scope thereof.

It is therefore intended by the appended claims to cover any and all such applications, modifications and embodiments within the scope of the present invention.

Accordingly,

What is claimed is:

1. An electrical joint, comprising:

a first object;

a second object movably aligned with said first object;

a conductive slurry deposited upon a first surface of said first object, said first object further comprising a conductive coating disposed upon said first surface at a position to electrically couple said conductive slurry to said conductive coating; and a conductor coupled to said second object, said conductor aligned to maintain conductive coupling with said conductive slurry while said first object and said second object move relative to one other.

2. The electrical joint of claim 1 wherein said conductive coating is electroplated to said first surface.

3. The electrical joint of claim 1 wherein said first surface is substantially planar and said objects are constrained to move parallel to first surface.

4. The electrical joint of claim 1 wherein said conductive slurry comprises metallic particles suspended in a fluid.

5. The electrical joint of claim 4 wherein said metallic particles are silver or copper.

6. The electrical joint of claim 1 wherein said first object is formed from an insulator.

7. The electrical joint of claim 6 wherein said insulator is polymide.

8. The electrical joint of claim 1 further comprising a non-conductive gel disposed upon an exposed surface of said conductive slurry and wherein said conductor extends through said non-conductive gel to maintain said conductive coupling.

9. The electrical joint of claim 8 wherein said non-conductive gel is hydraulic vacuum oil.

10. The electrical joint of claim 1 wherein said conductive slurry is disposed within a channel of said first surface, said channel positioned to maintain alignment with said conductor as said objects move.

11. The electrical joint of claim 10 wherein said channel is defined by a groove formed in said first surface.

12. The electrical joint of claim 10 wherein said channel is defined by built-up material extending from said first surface.

13. The electrical joint of claim 1 wherein said first object and said second object are moveably aligned about an axis or rotation, and said first surface is cylindrical, having a centerline substantially aligned with said axis of rotation.

14. The electrical joint of claim 13 wherein said conductor is a conductive blade that extends radially from said second object to maintain conductive coupling with said conductive slurry as said first object and said second object rotate with respect to one another.

15. The electrical joint of claim 14 wherein said blade is a conductive disk.

16. The electrical joint of claim 1 wherein said first surface is planar and said second object is moveably aligned to rotate about centerline extending substantially perpendicular from said first surface, and wherein said conductive slurry is disposed along a circular path defined by the movement of said conductor as said first object and said second object rotate with respect to one another.

17. The electrical joint of claim 16 wherein said conductor is a dowel extending from said second object to engage said circular path of conductive slurry.

18. The electrical joint of claim 17 wherein said conductor comprises a plurality of dowels extending from said second object and located at positions about a circle such that all of said plurality of dowels engage said circular path of conductive slurry.

19. An apparatus for conductively coupling a first plurality of conductors to a second plurality of conductors across a rotary joint, comprising:

an insulative cylinder having a first surface with a plurality of open channels formed therein, said channels circularly disposed about the axis of said cylinder;

a plurality of conductive coatings, one disposed within each of said plurality of channels, and respectively coupled to the first plurality of conductors;

a conductive slurry disposed upon said conductive coating in each of said plurality of channels, said conductive slurry comprised of metal particles suspended in a fluid;

a non-conductive gel disposed upon the exposed surface of said conductive slurry in each of said plurality of open channels;

a shaft rotatably coupled to said cylinder about the axis; and a plurality of conductive blades fixed to and extending radially from said shaft and disposed at positions along said shaft aligned with said plurality of open channels; said plurality of blades extending through said non-conductive gel to conductively engage said conductive slurry, said plurality of conductive blades respectively coupled to the second plurality of conductors.

20. An apparatus for conductively coupling a first plurality of conductors to a second plurality of conductors across a rotary joint, comprising:

a first insulative object having a substantially planar surface with a plurality of open channels formed therein, said channels disposed in concentric circles about an axis lying substantially perpendicular to said planar surface;

a plurality of conductive coatings, one disposed within each of said plurality of channels, and respectively coupled to the first plurality of conductors;

a conductive slurry disposed upon said conductive coating in each of said plurality of channels, said conductive slurry comprised of metal particles suspended in a fluid;

a non-conductive gel disposed upon the exposed surface of said conductive slurry in each of said plurality of open channels;

a second object rotatably coupled to said first object about said axis; and a plurality of conductive dowels fixed to and extending from said second object perpendicular to said planar surface and disposed at positions to rotate in alignment with said plurality of open channels, said plurality of dowels extending through said non-conductive gel to conductively engage said conductive slurry, said plurality of conductive dowels respectively coupled to the second plurality of conductors.

21. An electrical joint, comprising:

a first object;

a second object movably aligned with said first object;

a conductive slurry deposited upon a first surface of said first object;

a conductor coupled to said second object, said conductor aligned to maintain conductive coupling with said conductive slurry while said first object and said second object move relative to one other; and a non-conductive gel disposed upon an exposed surface of said conductive slurry and wherein said conductor extends through said non-conductive gel to maintain said conductive coupling.

22. The electrical joint of claim 21 wherein said non-conductive gel is hydraulic vacuum oil.

23. The electrical joint claim 21 wherein said first surface is substantially planar and said objects are constrained to move parallel to first surface.

24. The electrical joint of claim 21 wherein said conductive slurry comprises metallic particles suspended in a fluid.

25. The electrical joint of claim 24 wherein said metallic particles are silver or copper.

26. The electrical joint of claim 21 wherein said first object is formed from an insulator.

27. The electrical joint of claim 26 wherein said insulator is polymide.

28. The electrical joint of claim 21 wherein said conductive slurry is disposed within a channel of said first surface, said channel positioned to maintain alignment with said conductor as said objects move.

29. The electrical joint of claim 28 wherein said channel is defined by a groove formed in said first surface.

30. The electrical joint of claim 28 wherein said channel is defined by built-up material extending from said first surface.

31. The electrical joint of claim 8 wherein said conductive coating is electroplated to said first surface.

32. The electrical joint of claim 21 wherein said first object and said second object are moveably aligned about an axis or rotation, and said first surface is cylindrical, having a centerline substantially aligned with said axis of rotation.

33. The electrical joint of claim 32 wherein said conductor is a conductive blade that extends radially from said second object to maintain conductive coupling with said conductive slurry as said first object and said second object rotate with respect to one another.

34. The electrical joint of claim 33 wherein said blade is a conductive disk.

35. The electrical joint of claim 21 wherein said first surface is planar and said second object is moveably aligned to rotate about a centerline extending substantially perpendicular from said first surface, and wherein said conductive slurry is disposed along a circular path defined by the movement of said conductor as said first object and said second object rotate with respect to one another.

36. The electrical joint of claim 35 wherein said conductor is a dowel extending from said second object to engage said circular path of conductive slurry.

37. The electrical joint of claim 36 wherein said conductor comprises a plurality of dowels extending from said second object and located at positions about a circle such that all of said plurality of dowels engage said circular path of conductive slurry.

* * * * *